US009321094B2

(12) United States Patent
Choi

(10) Patent No.: US 9,321,094 B2
(45) Date of Patent: Apr. 26, 2016

(54) PRESS APPARATUS FOR VEHICLE

(71) Applicant: Hyundai Motor Company, Seoul (KR)

(72) Inventor: Yong Seok Choi, Ulsan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 14/491,112

(22) Filed: Sep. 19, 2014

(65) Prior Publication Data

US 2015/0183018 A1 Jul. 2, 2015

(30) Foreign Application Priority Data

Dec. 30, 2013 (KR) ..... 10-2013-0167827

(51) Int. Cl.

| | |
|---|---|
| ***B21D 37/08*** | (2006.01) |
| ***B21D 37/04*** | (2006.01) |
| ***B21D 24/04*** | (2006.01) |
| ***B21D 37/12*** | (2006.01) |
| ***B21D 19/08*** | (2006.01) |
| *B21D 53/88* | (2006.01) |

(52) U.S. Cl.

CPC ..... *B21D 37/08* (2013.01); *B21D 19/084* (2013.01); *B21D 24/04* (2013.01); *B21D 37/04* (2013.01); *B21D 37/12* (2013.01); *B21D 53/88* (2013.01)

(58) Field of Classification Search

CPC ..... B21D 19/08; B21D 19/084; B21D 22/04; B21D 22/06; B21D 37/08; B30B 1/40

See application file for complete search history.

(56) References Cited

U.S. PATENT DOCUMENTS 7,665,341 B2 * 2/2010 Kinoshita ..... B21D 5/04 72/315

FOREIGN PATENT DOCUMENTS

| | | |
|---|---|---|
| JP | 07-003827 U | 1/1995 |
| KR | 10-2009-0046676 A | 5/2009 |

* cited by examiner

*Primary Examiner* — Debra Sullivan

(74) *Attorney, Agent, or Firm* — Mintz Levin Cohn Ferris Glovsky and Popeo, P.C.; Peter F. Corless

(57) ABSTRACT

A press apparatus includes a lower die cam base slidably disposed inside of a lower die, and having a lower die pad connected to a upper portion of the lower die cam base; an upper die pad mounted under an upper die through a cushion spring at a position corresponding to the lower die pad; and an upper die cam slide having a cam slide surface formed at a lower portion, a cam surface formed at an upper portion, and a cam steel mounted to the upper die cam slide.

12 Claims, 3 Drawing Sheets

(S2)

(S1)

PRESS APPARATUS FOR VEHICLE

CROSS-REFERENCE TO RELATED APPLICATION

This application claims under 35 U.S.C. §119(a) priority to and the benefit of Korean Patent Application No. 10-2013-0167827 filed in the Korean Intellectual Property Office on Dec. 30, 2013, the entire contents of which are incorporated herein by reference.

BACKGROUND (a) Field of the Invention

The present invention relates to a press apparatus, more particularly, to a press apparatus which may prevent wrinkles from forming on a flange surface of a panel.

(b) Description of the Related Art

Generally, a vehicle is manufactured by numerous assembling processes using about 20,000 to 30,000 parts.

In particular, a vehicle body is formed by a first assembling process such that vehicle body panels are produced in a press process, and each part of the vehicle body is then assembled in a vehicle body factory to form a vehicle body of a body-in-white (BIW) state.

In order to form the panels, as described above, a forming process is performed for press forming the panels in a predetermined shape with various presses, and then cutting, hole forming, curving, and bending are performed in press processes, such as trimming, piercing, flanging, and hemming.

In a press forming process, a flange of a panel is under processed considering elastic restoring. In particular, "Spring Back" occurs when a flat-rolled metal or alloy is cold-worked; upon release of the forming force, the material has a tendency to partially return to its original shape because of the elastic recovery of the material. This is called "Spring Back" and influenced not only by the tensile and yield strengths, but also by thickness, bend radius and bend angle.

Recently, to enhance the appearance of a vehicle, bent shapes are applied to a vehicle body. Particularly, for applying a panorama sunroof to the vehicle, forming depth may be required to be increased.

However, for applying deep forming depth to the vehicle body, two steps of forming processes, for example, a vertical direction flange forming process and a horizontal direction flange forming process, are required in the conventional art, and thus productivity may be deteriorated, and manufacturing cost may be increased.

Also, in cam forming process, tensile press forming may not be applied to the panel, and thus compress press forming may be applied. As a result, wrinkles may be formed on a flange surface contributing to an inferior appearance, and thus increasing an inferiority rate.

Due to such wrinkles, welding quality may be deteriorated, and elements may not be easily mounted to the vehicle body.

The above information disclosed in this Background section is only for enhancement of understanding of the background of the invention and therefore it may contain information that does not form the prior art that is already known in this country to a person of ordinary skill in the art.

SUMMARY

The present invention discloses a press apparatus having advantages of preventing wrinkles from forming on a panel of a vehicle body by implementing tensile press forming to the panel with deep depth forming such as a roof side panel.

The present invention provides a press apparatus having advantages of improving productivity and reducing an inferiority rate.

A press apparatus according to an exemplary embodiment of the present invention may include a lower die cam base slidably disposed inside of a lower die, and having a lower die pad connected to a upper portion thereof, an upper die pad mounted under an upper die through a cushion spring at a position corresponding to the lower die pad, and an upper die cam slide having a cam slide surface formed at a lower portion thereof, a cam surface formed at an upper portion thereof, and a cam steel mounted thereto.

The press apparatus may further include a holding unit mounted to the lower die cam base and the upper die cam slide for holding a flange surface of a panel during press forming.

The holding unit may include a lower holding pad mounted to the lower die cam base for holding an inner portion of the flange surface of the panel, and an upper holding pad mounted to the upper die cam slide for holding an outer portion of the flange surface of the panel corresponding to the lower holding pad.

The lower holding pad and the upper holding pad may be mounted to the lower die cam base and the upper die cam slide, respectively, interposing a pad cushion spring between the lower holding pad and the lower die cam base, and between the upper holding pad and the upper die cam slide for supplying elastic force to the lower holding pad and the upper holding pad, respectively.

The holding unit may hold the flange surface during the press forming of the panel for the panel to be stretched formed.

The press apparatus may include a connecting block contacting the lower die cam base and slidable within the lower die and a lower die driver mounted under the upper die, and the lower die driver pushing the lower die cam base through the connecting block when the upper die moves down.

A driving surface may be formed to the lower die driver for pushing the connecting block.

A contacting surface may be formed to the connecting block contacting the driving surface of the lower die driver.

The press apparatus may further include wear plates interposed between the lower die and the connecting block and between the lower die and the lower die cam base respectively.

The lower die driver may push the lower die cam base through the connecting block to move the lower die cam base toward the upper die cam slide when the upper die moves down.

The press apparatus may further include a cam guide block formed apart from the lower die cam base and having a cam guide surface that slants toward the lower die cam base, and a cam driver having a cam driving surface that slants in an opposite direction of the cam guide surface and mounted under the upper die.

An insert portion may be formed to the lower die cam base, and the cam steel may be inserted into the insert portion for a panel to be stretched formed in press forming.

A press apparatus for press forming a panel inserted into an upper die and a lower die according to an exemplary embodiment of the present invention may include a lower die cam base slidably disposed inside of a lower die and having a forming shape corresponding to a lower surface of a lower portion of the panel, a connecting block contacting the lower die cam base and slidably disposed within the lower die, a lower die pad connecting upper portions of the lower die cam base and the connecting block and having a forming shape corresponding to a lower surface of an upper portion of the panel, a lower die driver mounted under the upper die to selectively push the lower die cam base through the connecting block, an upper die pad mounted under the upper die through a cushion spring at a position corresponding to the lower die pad and having a forming shape corresponding to an upper surface of an upper portion of the panel, a cam guide block formed to the lower die apart from the lower die cam base and having a cam guide surface that slants to the lower die cam base, an upper die cam slide having a cam slide surface corresponding to the cam guide surface of the cam guide block, of which a cam surface slant opposite direction of the cam slide surface, and the upper die cam slide having a cam steel mounted toward the lower die cam base thereto, a cam driver mounted under the upper die, and having a cam driving surface corresponding to the cam surface of the upper die cam slide, and a holding unit mounted to the lower die cam base and the upper die cam slide for holding a flange surface of the panel during press forming.

The holding unit may include a lower holding pad mounted to the lower die cam base for holding an inner portion of the flange surface of the panel, and an upper holding pad mounted to the upper die cam slide for holding an outer portion of the flange surface of the panel corresponding to the lower holding pad.

The lower holding pad and the upper holding pad may be mounted to the lower die cam base and the upper die cam slide respectively interposing a pad cushion spring between the lower holding pad and the lower die cam base, and between the upper holding pad and the upper die cam slide for supplying elastic force to the lower holding pad and the upper holding pad respectively.

The holding unit may hold the flange surface during the press forming of the panel for the panel to be stretched formed.

An insert portion may be formed to the lower die cam base, and the cam steel may be inserted into the insert portion for a panel to be stretched formed in press forming.

A press apparatus according to an exemplary embodiment of the present invention may prevent from forming wrinkle to a panel of a vehicle body by implementing tensile press forming to the panel with deep depth forming such as a roof side panel.

A press apparatus according to an exemplary embodiment of the present invention may improve productivity and reduce inferiority rate.

A press apparatus according to an exemplary embodiment of the present invention may enhance attractive appearance of a vehicle, welding quality and mounting quality of elements.

DETAILED DESCRIPTION OF THE EMBODIMENTS

Figure 1:
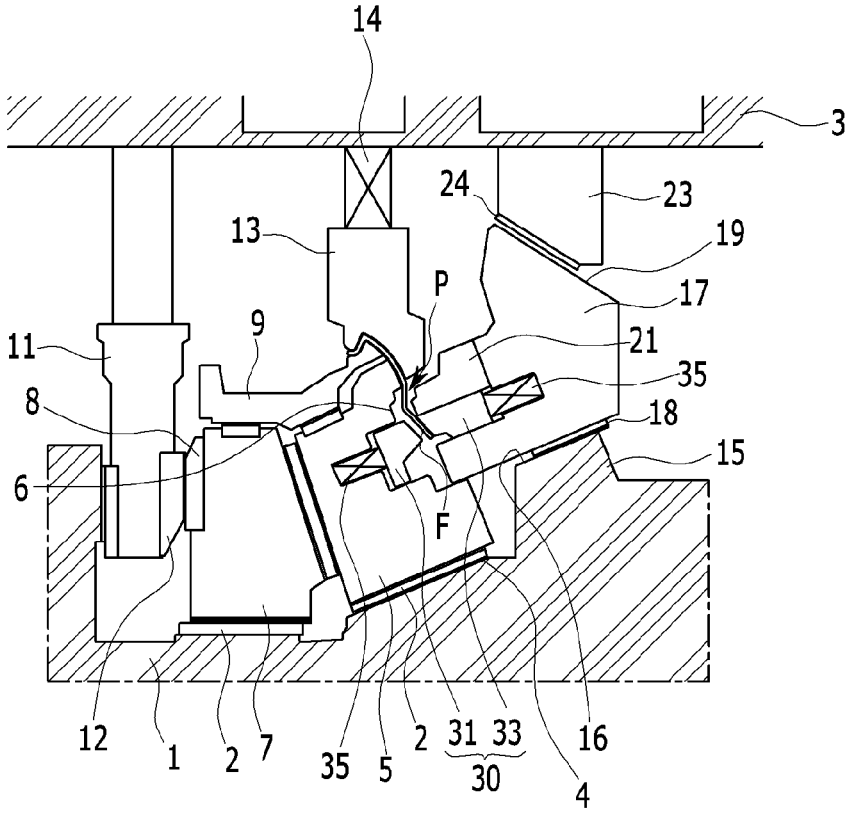
FIG. 1 is a cross-sectional view showing a press apparatus according to an exemplary embodiment of the present invention.

An exemplary embodiment of the present invention will hereinafter be described in detail with reference to the accompanying drawings.

As those skilled in the art would realize, the described embodiments may be modified in various different ways, all without departing from the spirit or scope of the present invention. Parts which are not associated with the description are omitted in order to specifically describe the present invention, and like reference numerals refer to like elements throughout the specification.

In addition, parts that are irrelevant to the description are omitted to clearly describe the exemplary embodiments of the present invention, and like reference numerals designate like elements throughout the specification, which also applies to the related art. The size and thickness of each component illustrated in the drawings are arbitrarily shown for understanding and ease of description, but the present invention is not limited thereto. Thicknesses of several portions and regions are enlarged for clear expressions.

In addition, "unit", "means", "part", "member", or the like, which is described in the specification, means a unit of a comprehensive configuration that performs at least one function or operation.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Further, the control logic of the present invention may be embodied as non-transitory computer readable media on a computer readable medium containing executable program instructions executed by a processor, controller or the like. Examples of computer readable media include, but are not limited to, ROM, RAM, compact disc (CD)-ROMs, magnetic tapes, floppy disks, flash drives, smart cards and optical data storage devices. The computer readable medium can also be distributed in network coupled computer systems so that the computer readable media is stored and executed in a distributed fashion, e.g., by a telematics server or a Controller Area Network (CAN).

FIG. 1 depicts a press apparatus according to an exemplary embodiment of the present invention.

Referring to FIG. 1, a press apparatus according to an exemplary embodiment of the present invention may prevent wrinkles from being formed on a flange surface F of a panel P of a vehicle body by implementing tensile press forming to a panel with deep depth forming such as a roof side panel, improve productivity and reduce inferiority rate.

In an exemplary embodiment of the present invention, a lower die 1 is disposed, and an upper die 3 is movable up and down over the lower die 1, and the panel P is inserted between the lower die 1 and the upper die 3 to be pressed.

The press apparatus according to an exemplary embodiment of the present invention may include a lower die cam base 5, a connecting block 7, a lower die pad 9, a lower die driver 11, an upper die pad 13, a cam guide block 15, an upper die cam slide 17, a cam driver 23, and a holding unit 30.

The lower die cam base 5 is slidably disposed within the lower die 1, and has a forming shape corresponding to a lower surface of a lower portion of the panel P.

The connecting block 7 contacts the lower die cam base 5 and is slidably disposed within the lower die 1.

The lower die pad 9 connects upper portions of the lower die cam base 5 and the connecting block 7 and has a forming shape corresponding to a lower surface of an upper portion of the panel P.

Wear plates 2 may be disposed between the lower die 1 and the lower die cam base 5, and between the lower die 1 and the connecting block 7, respectively.

The wear plate 2 may allow the lower die cam base 5 and the connecting block 7 to move on the lower die 1 smoothly.

The lower die driver 11 is mounted under the upper die 3 and contacts the connecting block 7 through a driving surface 12 formed thereto.

A contacting surface 8 is formed to the connecting block 7 corresponding to the driving surface 12 of the lower die driver 11.

When the upper die 3 moves down, the lower die driver 11 contacts the contacting surface 8 of the connecting block 7 through the driving surface 12 and pushes the connecting block 7 and the lower die cam base 5 toward the upper die cam slide 17.

At a portion of the lower die 1 where the lower die cam base 5 is disposed thereto, a lower die cam base surface 4 slants toward the upper die cam slide 17.

The upper die pad 13 is mounted under the upper die 3 through a cushion spring 14 at a position corresponding to the lower die pad 9 and has a forming shape corresponding to an upper surface of an upper portion of the panel P.

The cam guide block 15 is formed to the lower die 1 apart from the lower die cam base 5 and a cam guide surface slants to the lower die cam base 5.

The upper die cam slide 17 has a cam slide surface 18 corresponding to the cam guide surface 16 of the cam guide block 15, a cam surface 19 slants in an opposite direction of the cam slide surface 18.

A cam steel 21 preferably is mounted to the upper die cam slide 17 toward the lower die cam base 5.

The cam driver 23 is mounted under the upper die 3, and a cam driving surface 24 corresponding to the cam surface 19 of the upper die cam slide 17 is formed to the cam driver 23.

The holding unit 30 is mounted to the lower die cam base 5 and the upper die cam slide 17 for holding the flange surface F of the panel P during press forming.

The holding unit 30 may maintain a holding state of the flange surface F during press forming using the lower die cam base 5 and the upper die cam slide 17 so that the panel P may be stretched formed in press forming.

The holding unit 30 includes a lower holding pad 31 mounted to the lower die cam base 5 for holding an inner portion of the flange surface F of the panel P and an upper holding pad 33 mounted to the upper die cam slide 17 for holding an outer portion of the flange surface F of the panel P corresponding to the lower holding pad 31.

The lower holding pad 31 and the upper holding pad 33 are mounted to the lower die cam base 5 and the upper die cam slide 17, respectively, interposing a pad cushion spring 35 between the lower holding pad 31 and the lower die cam base 5, and between the upper holding pad 33 and the upper die cam slide 17 for supplying elastic force to the lower holding pad 31 and the upper holding pad 33, respectively.

An insert portion 6 is formed to the lower die cam base 5, and the cam steel 21 is inserted into the insert portion 6 for the panel P to be stretched formed in press forming.

Hereinafter, operations of the press apparatus according to an exemplary embodiment of the present invention will be discussed.

Figure 2:
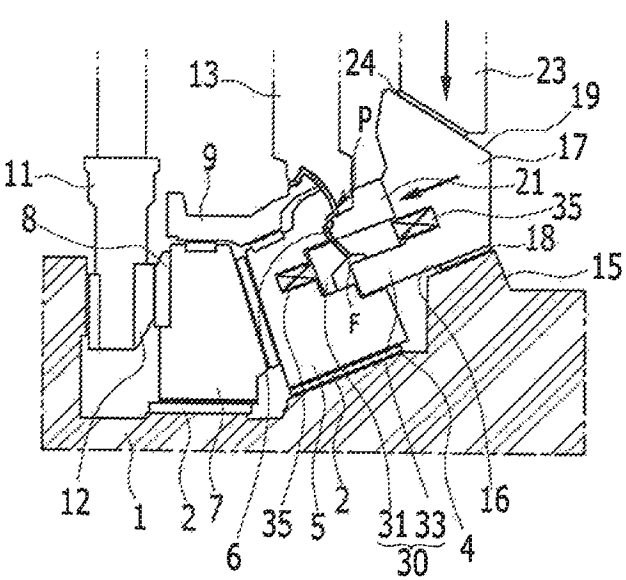
FIG. 2 is a cross-sectional view showing operations of the press apparatus of FIG. 1.
Figure 2:
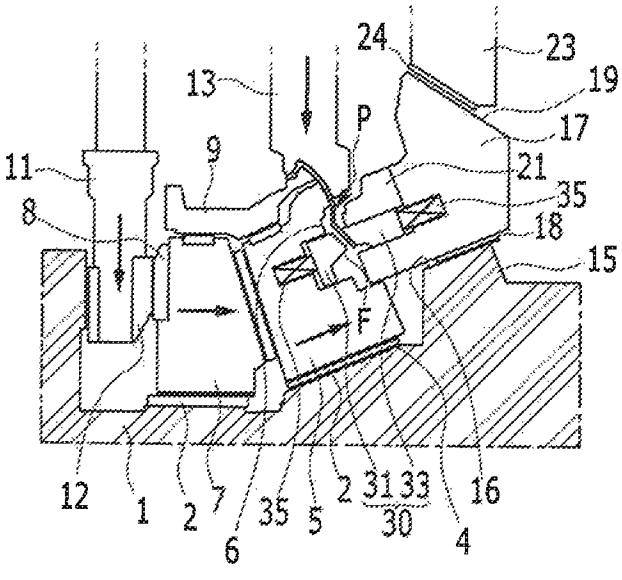
Figure 3:
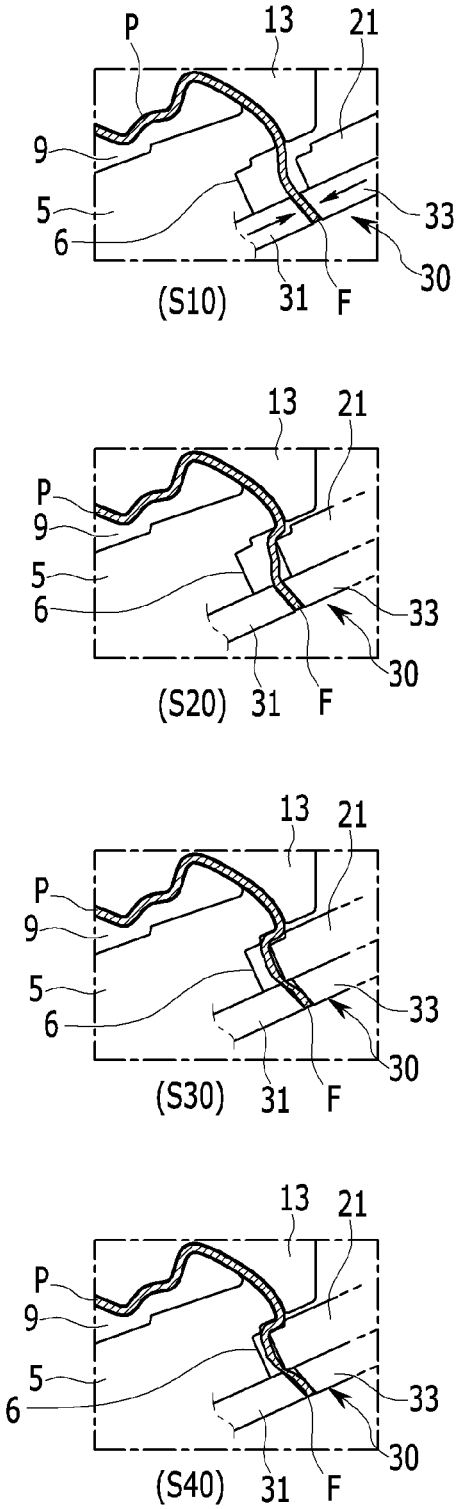
FIG. 3 is a schematic view showing steps of pressing a panel by the press apparatus of FIG. 1.

FIG. 2 depicts operations of the press apparatus of FIG. 1, and FIG. 3 shows a pressed panel being formed by the press apparatus of FIG. 1.

In the state that the panel P is interposed between the lower die cam base 5 and the lower die pad 9, the upper die 3 moves down as shown in S1 of FIG. 2, the lower die driver 11 moves down together with the upper die 3, and the driving surface 12 contacts the contacting surface 8 of the connecting block 7. Then, the driving surface 12 pushes the contacting surface 8 so as to move the connecting block 7 and the lower die cam base 5 toward the upper die cam slide 17.

In this state, the upper die pad 13 pushes the lower die pad 9 and is elastically supported by the cushion spring 14 to press the upper portion of the panel P having a forming depth that is relatively not deep together with the lower die pad 9.

The upper die 3 keeps going down as shown in S2 of FIG. 2, and then the cam driving surface of the cam driver 23 pushes the cam surface 19 of the upper die cam slide 17.

At the state that the cam slide surface 18 of the upper die cam slide 17 contacts the cam guide surface 16 of the cam guide block 15, the upper die cam slide 17 slides toward the lower die cam base 5 on the cam guide surface 16 during downward movement of the cam driver 23.

In this state, the lower holding pad 31 of the holding unit 30 contacts an inner side of the flange surface F of the panel P and the upper holding pad 33 of the holding unit 30 contacts an outer side of the flange surface F of the panel P to hold the flange surface F.

Each pad cushion spring 35 supplies elastic force to the lower holding pad 31 and the upper holding pad 33 for the flange surface F of the panel P not to be separated from the holding unit 30.

In particular, before press forming using the cam steel 21, the holding unit 30 holds the flange surface F of the panel P. Then, the upper die cam slide 17 presses the lower portion of the panel P with deep forming depth through the cam steel 21.

As shown in S10 to S40 of FIG. 3, at the state that the holding unit 30 holds the flange surface F of the panel P, the cam steel 21 is inserted toward the insert portion 6 to push the panel P and the holding unit 30 moves together with the cam steel 21.

In particular, the holding unit 30 holding the flange surface F of the panel P moves along the moving direction of the cam steel 21 for example before about 10 mm of the end of the press forming. Thus, while the cam steel 21 is inserted into the insert portion 6 of the lower die cam base 5, the panel P is stretched formed in press forming to prevent from forming wrinkles.

According to the exemplary embodiment of the present invention, the press apparatus may prevent from forming wrinkles on the flange surface F of the panel P of a vehicle body by implementing tensile press forming to a panel with deep depth forming such as a panorama sunroof. The press apparatus according to an exemplary embodiment of the present invention may improve productivity and reduce inferiority rate.

Also, the press apparatus according to an exemplary embodiment of the present invention may enhance attractive appearance of a vehicle, welding quality and mounting quality of elements.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A press apparatus, comprising:

a lower die cam base slidably disposed inside of a lower die, wherein a lower die pad is connected to an upper portion of the lower die cam base;

an upper die pad mounted under an upper die through a cushion spring at a position corresponding to the lower die pad;

an upper die cam slide having a cam slide surface formed at a lower portion thereof, a cam surface formed at an upper portion thereof, and a cam steel mounted thereto; and a holding unit mounted to the lower die cam base and the upper die cam slide for holding a flange surface of a panel during press forming, wherein the holding unit comprises:

a lower holding pad mounted to the lower die cam base for holding an inner portion of the flange surface of the panel; and an upper holding pad mounted to the upper die cam slide for holding an outer portion of the flange surface of the panel corresponding to the lower holding pad, wherein the lower holding pad and the upper holding pad are mounted to the lower die cam base and the upper die cam slide, respectively, interposing a pad cushion spring between the lower holding pad and the lower die cam base, and between the upper holding pad and the upper die cam slide for supplying elastic force to the lower holding pad and the upper holding pad, respectively.

2. The press apparatus of claim 1, wherein the holding unit holds the flange surface during press forming of the panel for the panel to be stretched formed.

3. The press apparatus of claim 1, further comprising:

a connecting block contacting the lower die cam base and slidable within the lower die; and a lower die driver mounted under the upper die, and the lower die driver pushing the lower die cam base through the connecting block when the upper die moves down.

4. The press apparatus of claim 3, wherein a driving surface is formed to the lower die driver for pushing the connecting block.

5. The press apparatus of claim 4, wherein a contacting surface is formed to the connecting block contacting the driving surface of the lower die driver.

6. The press apparatus of claim 3, further comprising wear plates interposed between the lower die and the connecting block and between the lower die and the lower die cam base, respectively.

7. The press apparatus of claim 3, wherein the lower die driver pushes the lower die cam base through the connecting block to move the lower die cam base toward the upper die cam slide when the upper die moves down.

8. The press apparatus of claim 1, further comprising:

a cam guide block formed apart from the lower die cam base and including a cam guide surface that slants toward the lower die cam base; and a cam driver including a cam driving surface that slants in an opposite direction of the cam guide surface and mounted under the upper die.

9. The press apparatus of claim 1, wherein:

an insert portion is formed to the lower die cam base; and the cam steel is inserted into the insert portion for a panel to be stretched formed in press forming.

10. A press apparatus for press forming a panel inserted into an upper die and a lower die, the press apparatus comprising:

a lower die cam base slidably disposed inside of the lower die and having a forming shape corresponding to a lower surface of a lower portion of the panel to be formed;

a connecting block contacting the lower die cam base and slidably disposed within the lower die;

a lower die pad connecting upper portions of the lower die cam base and the connecting block and having a forming shape corresponding to a lower surface of an upper portion of the panel to be formed;

a lower die driver mounted under the upper die to selectively push the lower die cam base through the connecting block;

an upper die pad mounted under the upper die through a cushion spring at a position corresponding to the lower die pad and having a forming shape corresponding to an upper surface of an upper portion of the panel to be formed;

a cam guide block formed to the lower die apart from the lower die cam base and having a cam guide surface that slants to the lower die cam base;

an upper die cam slide having a cam slide surface corresponding to the cam guide surface of the cam guide block, a cam surface slant opposite direction of the cam slide surface, and the upper die cam slide having a cam steel mounted toward the lower die cam base thereto; and a holding unit mounted to the lower die cam base and the upper die cam slide for holding a flange surface of the panel during press forming, wherein the holding unit comprises:

a lower holding pad mounted to the lower die cam base for holding an inner portion of the flange surface of the panel; and an upper holding pad mounted to the upper die cam slide for holding an outer portion of the flange surface of the panel corresponding to the lower holding pad, wherein the lower holding pad and the upper holding pad are mounted to the lower die cam base and the upper die cam slide, respectively, interposing a pad cushion spring between the lower holding pad and the lower die cam base, and between the upper holding pad and the upper die cam slide for supplying elastic force to the lower holding pad and the upper holding pad, respectively.

11. The press apparatus of claim 10, wherein the holding unit holds the flange surface during the press forming of the panel for the panel to be stretched formed.

12. The press apparatus of claim 10, wherein:

an insert portion is formed to the lower die cam base; and the cam steel is inserted into the insert portion for a panel to be stretched formed in press forming.

* * * * *